United States Patent [19]

Furch et al.

[11] Patent Number: 4,545,755

[45] Date of Patent: Oct. 8, 1985

[54] APPARATUS FOR MAKING A PRESSED BODY

[75] Inventors: Benjamin Furch; Friedrich-Wilhelm Rost, both of Unterluess, Fed. Rep. of Germany

[73] Assignee: Rheinmetall GmbH, Duesseldorf, Fed. Rep. of Germany

[21] Appl. No.: 470,598

[22] Filed: Feb. 28, 1983

[30] Foreign Application Priority Data

Feb. 27, 1982 [DE] Fed. Rep. of Germany ..... 3207191

[51] Int. Cl.[4] ..... B28B 17/00

[52] U.S. Cl. ..... 425/420; 264/3 C; 425/812

[58] Field of Search ..... 425/420, 812; 264/102, 264/3 C; 249/141; 86/1 R

[56] References Cited

U.S. PATENT DOCUMENTS

| | | | |
|---|---|---|---|
| 1,826,945 | 10/1931 | McKay et al. | 425/420 |
| 2,607,435 | 8/1952 | Dohse | 183/44 |
| 2,865,052 | 12/1958 | Wilcox | 425/420 |
| 3,377,662 | 4/1968 | Fukushima | 425/812 |
| 3,822,857 | 7/1974 | Tanie | 425/812 |

FOREIGN PATENT DOCUMENTS 508598 7/1939 United Kingdom .

*Primary Examiner*—Jay H. Woo
*Assistant Examiner*—J. Fortenberry

[57] ABSTRACT

An apparatus for pressing a fluent powder into a rigid body comprises a die formed with an upwardly open and laterally closed pressing cavity adapted to hold a mass of the fluent particles to be pressed and a punch having a lower portion substantially complementary to and fittable in the pressing cavity and having a lower face engageable with the mass in the cavity. This punch is formed with a throughgoing vent passage having a lower end opening at the lower face and an upper end opening thereabove to the surroundings. An actuator can displace the punch relative to the die between an upper position clear thereof and a lower position engaged in the cavity and compressing the mass therein and through an intermediate position between the upper and lower positions. A valve body in the passage permits free gas flow therethrough when the punch is in and between the intermediate and upper positions and blocks flow therethrough between the intermediate and lower positions.

11 Claims, 6 Drawing Figures

APPARATUS FOR MAKING A PRESSED BODY

FIELD OF THE INVENTION

The present invention relates to an apparatus for making a pressed body. More particularly this invention concerns such an apparatus that compresses a powder, for instance an explosive, into a hard compressed body, for instance a charge or primer.

BACKGROUND OF THE INVENTION

It is standard practice to compress a fluent mass of explosive powder into a rigid body suitable for ordinance and related purposes. Obviously this procedure must avoid anything that could set off the explosive.

The normal method is to charge an appropriate metered quantity of the powder from which the body is to be made into a cup-shaped mold or die, and to compress it therein with a complementarily shaped stamp or punch. When the powder being used is quite fine and fluent as is common in the production of explosives, it is necessary that the punch fit very snugly into the die. This creates the problem of trapping and compressing air in the die with the powder. If the air is not allowed to escape, its compression will heat it, possibly setting off an explosion. It is also possible for the resultant body to be made somewhat porous and friable by gas inclusions in it.

Accordingly it has been suggested to provide radially throughgoing holes in the wall of the mold or die slightly above the level where the upper surface of the charged-in mound of material should be. Thus as the punch descends in the die it will expel the air through these holes, the pressing chamber formed between the punch and die only being fully closed off when the punch passes these openings, which should happen just before it comes into contact with the powder being pressed.

Such an arrangement cannot readily be used when the die is held, as is common, in a liquid bath to maintain it at a predetermined temperature due to the danger of leakage into the die. Furthermore if the material is not smoothly mounded in the die it can rise at one location up over one of the holes so that this portion of the powder is blown out this hole as the die descends, possibly blocking this hole. Finally such a system requires that a given mold or die always be used with a given quantity of powder since the holes cannot be moved, and even when it works well a small amount of air is compressed into the body due to the short distance the punch must travel for safety's sake between the position when it covers the holes and when it contacts the mass being compressed.

Hence it has been suggested to operate in a vacuum. Such a procedure entails considerable equipment costs. The punches and dies must be contained in a vacuum chamber and some means must be provided for feeding the explosive powder to the dies in the chamber. Overall the equipment needed for operation in this manner is prohibitively complex and expensive.

OBJECTS OF THE INVENTION

It is therefore an object of the present invention to provide an improved apparatus for pressing a fluent powder into a rigid body.

Another object is the provision of such an apparatus for pressing a fluent powder into a rigid body which overcomes the above-given disadvantages.

A yet further object is to provide a simple pressing apparatus which can reliably press an explosive powder without compressing substantial air with the powder.

SUMMARY OF THE INVENTION

These objects are attained according to the instant invention is such an apparatus which comprises a die formed with an upwardly open and laterally closed pressing cavity adapted to hold a mass of the fluent particles to be pressed and a punch having a lower portion substantially complementary to and fittable in the pressing cavity and having a lower face engageable with the mass in the cavity. This punch is formed with a throughgoing vent passage having a lower end opening at the lower face and an upper end opening thereabove to the surroundings. An actuator can displace the punch relative to the die between an upper position clear thereof and a lower position engaged in the cavity and compressing the mass therein and through an intermediate position between the upper and lower positions. A valve in the passage permits free gas flow therethrough when the punch is in and between the intermediate and upper positions and blocks flow therethrough between the intermediate and lower positions.

According to the invention the die and punch are generally centered on an upright axis and the punch is movable axially between its positions. The passage extends mainly axially and has an upper section extending generally radially and opening radially outward.

More particularly the punch includes a rod-like upper part and a cup-shaped lower part threaded to the upper part. The lower part is formed with an inner and upwardly directed shoulder and the upper part has a lower end face bearing on the shoulder and forming therewith a chamber constituting part of the passage. This chamber contains the valve means.

In other words, the punch of this invention is formed with a valve chamber having axially spaced upper and lower walls and with a lower passage extending axially from the lower wall to the lower face and an upper passage opening at one end into the chamber at the upper wall and an opposite end opening to the exterior. The valve means includes a valve body displaceable in the chamber between a lower position clear of the upper end wall, overlying the lower passage, and permitting flow through the chamber between the passages and an upper position engaged upward against the upper wall and blocking the one end of the upper passage. When the fluent material rises in the lower passage it lifts the valve body into the upper position. To this end the valve body has a smooth upper face sealingly engageable with the upper wall and a grooved lower face engageable with the lower wall.

With this system therefore the valve closes when a small quantity of the fluent material being pressed rises up in the lower passage and contacts the valve body, pressing it up against the upper wall of the chamber and cutting off the upper passage. Thus the system responds to the actual powder level in the die, and automatically vents all the air above the powder. The level of the powder in the cavity is irrelevant; the valve only closes when it contacts the powder and this powder rises in the lower passage.

According to another feature of this invention the valve body has a central part axially aligned with the passages and a plurality of radially extending centering arms maintaining the central part in axial alignment with the passages. The valve body itself is stellate and formed of a heat-resistant synthetic resin. It therefore is not shifted upward into the closed position by air flowing out through the passage, but is moved by the powder being pressed.

DESCRIPTION OF THE DRAWING

The above and other features and advantages will become more readily apparent from the following, reference being made to the accompanying drawing in which.

SPECIFIC DESCRIPTION

Figure 1:
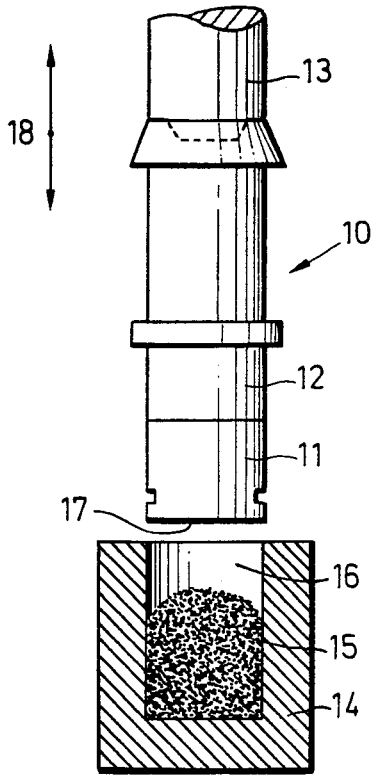
FIG. 1 is a side view of the pressing apparatus according to this invention.

As seen in FIG. 1 an apparatus for pressing a mass 15 of fluent material, here powder for forming a primer cap, basically comprises a punch 10 displaceable vertically as shown by double arrow 18 toward and away from a stationary die 14 formed with a cylindrical cavity 16 holding the mass 15. An actuator having a lower end 13 serves to press the punch 10 down into the complementarily shaped cavity 16.

Figure 2:
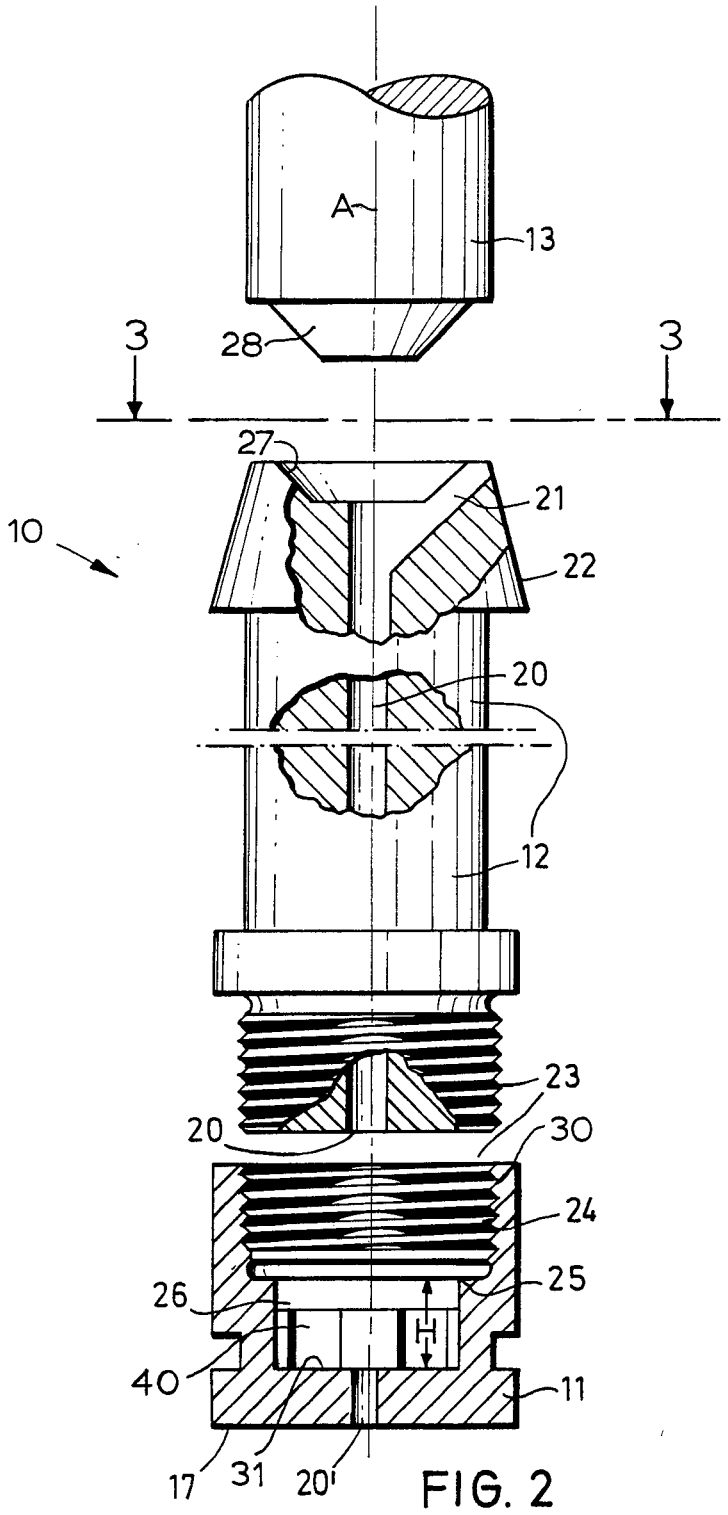
FIG. 2 is an exploded and partly sectional view of a detail of FIG. 1.
Figure 3:
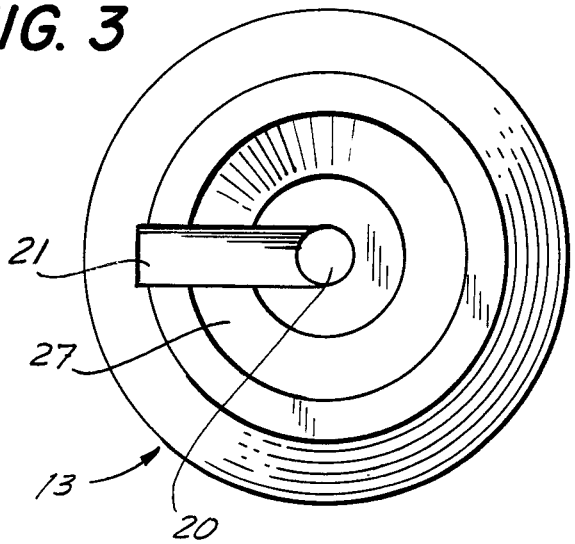
FIG. 3 is a view taken in the direction of arrows 3 of FIG. 2.

The punch 10, as shown in better detail in FIG. 2, basically comprises an upper part or stem 12 having an upper end formed with a frustoconical recess 27 complementary to a frustoconical tip 28 on the actuator 13 and a lower end formed with an external thread 23. This stem 12 is centered like the actuator 13 and the die 14 on an axis A and is formed with an axially throughgoing bore 20 that opens at its lower end at a face 29 that is planar and perpendicular to the axis A. At its upper end the bore or passage 20 connects to a lateral passage or groove 21 (see also FIG. 3) that opens externally into the surroundings, so that even when the tip 28 is fitted into the recess 27 the passage 20 is vented to the exterior and at ambient pressure.

The punch 10 further has a cup-shaped lower part 11 having an internal screwthread 30 that mates with the screwthread 23, with the face 29 flatly abutting a shoulder 25 lying in a plane perpendicular to the axis A. Internally this part 11 is formed with a cylindrical chamber 26 centered on the axis A and having an axial dimension or height H. A short axially centered bore 20' extends between a planar surface 31 spaced by the distance H from the face 29 and the planar lower face 17 of the punch 10.

Figure 6:
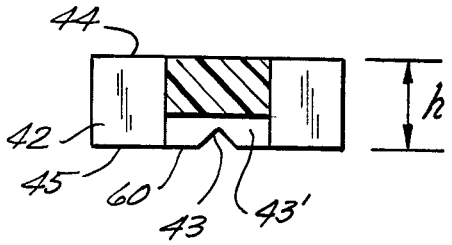
FIG. 6 is a section taken along line b—b of FIG. 4.
Figure 5:
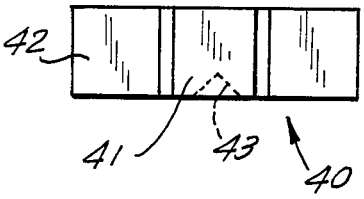
FIG. 5 is a view taken in the direction of arrow B of FIG. 4.
Figure 4:
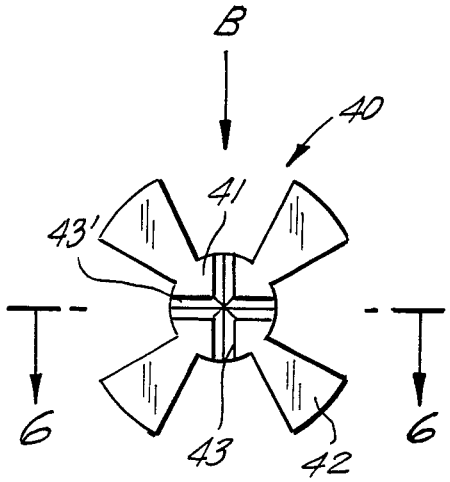
FIG. 4 is a bottom view of the valve body used in the structure shown in FIG. 2.

This chamber 26 contains a stellate valve body 40 shown in better detail in FIGS. 4, 5, and 6. This body 40 is formed of a durable heat-resistant polycarbonate such as Makrolon, a product of Farbenfabriken Bayer AG., and has a planar lower face 45 and a planar upper face 44. The lower face 45 has a groove (43 and 43'). The grooves 43 and 43' are formed as perpendicularly crossing V-section grooves 43 and 43'. Between the faces 44 and 45 the body 40 has an axial height h equal to substantially less than the height H of the chamber 26 so that the body 40 can move limitedly axially in this chamber 26, between the faces 29 and 31. The body has a center part 41 from which project four identical arms 42 that give it a radial dimension equal generally to that of the chamber 26 so that these arms 42 keep the part 41 centered at the axis A and between the bores or passages 20 and 20' that are of smaller diameter than center part 41.

In use a metered quantity of the explosive powder 14 is poured into the chamber 16, then the actuator 13 pushes the punch 10 down into the cavity 16 so that the lower surface 17 closes and seals off the cavity 16. Continued downward displacement of this punch 10 from this intermediate position therefore compresses the air in the cavity 16, forcing it up into the passage 20', then radially out in the grooves 43 and 43', then axially up through the cylinder 26 and passage 20, and finally radially out through the passage section 21.

When the lower face 17 contacts the fluent mass 15 some of it will be forced up in the passage 20' to engage the bottom face 45 of the body 40. Since the particles of the mass 15 are not as fluent as the air that flowed up through the passage 20' ahead of them, they will push this body 40 up until its flat upper face 44 comes to lie against the flat face 29 of the stem 12, thereby tightly sealing off the lower end of the upper passage portion 20. Further downward displacement of the punch 10 will take place with no appreciable venting or entrance of particles or gas into the stem 12. The mass 15 will be compressed between the lower face 17 of the punch 10 and the floor of the cavity 16.

Thereupon the punch 10 can be left in the die 14 until the mass hardens. After separation of the two and emptying out of the hard body, the material in the punch 10 can simply be dissolved out, normally using warm water which will effectively dissolve most explosives and which will not harm the metallic punch parts 11 and 12 and the synthetic-resin valve body 40.

Thus the system of this invention insures that the gas in the die 14 will be effectively vented, but that this venting will be cut off as soon as particulate material starts to flow along the vent passage. In this manner no matter how much material is charged into the die 14 the gas above it will be vented accurately, with no appreciable waste of the particulate material or forcing of air into the body being formed.

We claim:

1. An apparatus for compressing a body of fluent particles of an explosive material, the apparatus comprising:

a die formed with an upwardly open and laterally closed pressing cavity adapted to hold a mass of the fluent particles to be pressed;

a punch having a lower portion substantially complementary to and fittable in the pressing cavity and having a lower face engageable with the mass in the cavity, the punch being formed with a throughgoing vent passage having a lower end opening at the lower face and an upper end opening thereabove to the surroundings;

said lower portion also including a chamber of predetermined axial extent;

means for displacing the punch relative to the die between an upper position clear thereof and a lower position engaged in the cavity and compressing the mass therein and through an intermediate position between the upper and lower positions; and a plate-like valve member having an axial extent which is less than that of said chamber reciprocally movably mounted in said chamber, said valve member having a lower face with groove means for permitting free gas flow therethrough when the punch is in and between the intermediate and upper positions and for blocking flow therethrough between the intermediate and lower positions.

2. The pressing apparatus defined in claim 1 wherein the die and punch are generally centered on an upright axis and the punch is movable axially between its positions, the passage extending mainly axially.

3. The pressing apparatus defined in claim 2 wherein the passage has an upper section extending generally radially and opening radially outward.

4. The pressing apparatus defined in claim 2 wherein the punch includes a rod-like upper part and a cup-shaped lower part threaded to the upper part.

5. The pressing apparatus defined in claim 4 wherein the lower part is formed with an inner and upwardly directed shoulder, the upper part having a lower end face bearing on the shoulder and forming a wall of said chamber which constitutes a part of the passage.

6. The pressing apparatus defined in claim 4, wherein the cup-shaped lower part forms said chamber constituting part of the passage and said valve member is disposed therein.

7. The pressing apparatus defined in claim 6, wherein the passage opens axially down into the chamber and includes a passage section extending axially from the chamber to a lower face of the punch, the valve member is blockingly engageable over the passage in the chamber.

8. The pressing apparatus defined in claim 7 wherein the chamber has upper and lower axially confronting and spaced end walls, the passage opening at the center of the upper wall, the valve member having a solid center part sealingly engageable over the passage at the upper wall.

9. The pressing apparatus defined in claim 8 wherein the valve member is made of stellate and formed of a heat-resistant synthetic resin.

10. An apparatus for pressing a mass of a fluent powder of an explosive material into a rigid body, the apparatus comprising:

a cup-shaped die formed with an upwardly open and laterally closed pressing cavity adapted to hold a mass of the fluent particles to be pressed;

a punch centered on an axis and having a lower portion substantially complementary to and fittable in the pressing cavity and having a lower face engageable with the mass in the cavity, the punch being formed of predetermined axial extent with a valve chamber having axially spaced upper and lower walls and with a lower passage extending axially from the lower wall to the lower face and an upper passage opening at one end into the chamber at the upper wall and an opposite end opening to the exterior said passages extending substantially axially;

means for displacing the punch axially relative to the die down into the cavity for compressing the mass therein between the lower face and the floor of the cavity; and valve means including a valve body displaceable in the chamber between a lower position clear of the upper end wall, overlying the lower passage, and permitting flow through the chamber between the passages and an upper position engaged upward against the upper wall and blocking the one end of the upper passage, whereby when the fluent material rises in the lower passage it lifts the valve body into the upper position; and said valve body has a smooth upper face sealingly engageable with the upper wall and a grooved lower face engageable with the lower wall.

11. The pressing apparatus defined in claim 10 wherein the valve body has a central part axially aligned with the passages and a plurality of radially extending centering arms maintaining the central part in axial alignment with the passages.

* * * * *